US010611600B2

(12) United States Patent
Morrison et al.

(10) Patent No.: US 10,611,600 B2
(45) Date of Patent: Apr. 7, 2020

(54) HYDRAULIC ELEVATOR SYSTEM WITH POSITION OR SPEED BASED VALVE CONTROL

(71) Applicant: OTIS ELEVATOR COMPANY, Farmington, CT (US)

(72) Inventors: Matthew Sean Morrison, West Hartford, CT (US); Robert K. Williams, Ed Dorado Hills, CA (US); Gregory M. O'Seep, Simsbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 388 days.

(21) Appl. No.: 15/632,635

(22) Filed: Jun. 26, 2017

(65) Prior Publication Data

US 2018/0370757 A1 Dec. 27, 2018

(51) Int. Cl.

| | |
|---|---|
| ***B66B 1/34*** | (2006.01) |
| ***F15B 11/04*** | (2006.01) |
| ***B66B 1/40*** | (2006.01) |
| ***B66B 1/24*** | (2006.01) |
| *B66B 1/50* | (2006.01) |
| *B66B 1/28* | (2006.01) |
| *B66B 5/04* | (2006.01) |

(52) U.S. Cl.

CPC ..... *B66B 1/343* (2013.01); *B66B 1/24* (2013.01); *B66B 1/3492* (2013.01); *B66B 1/405* (2013.01); *F15B 11/04* (2013.01); *B66B 1/285* (2013.01); *B66B 1/50* (2013.01); *B66B 5/04* (2013.01); *F15B 2211/30525* (2013.01); *F15B 2211/327* (2013.01); *F15B 2211/6336* (2013.01); *F15B 2211/665* (2013.01); *F15B 2211/75* (2013.01); *F15B 2211/765* (2013.01)

(58) Field of Classification Search

CPC ..... B66B 1/343; B66B 1/3492; B66B 1/405
USPC ..... 187/286
See application file for complete search history.

(56) References Cited

U.S. PATENT DOCUMENTS

| | | | | |
|---|---|---|---|---|
| 3,530,958 A | | 9/1970 | Brannon et al. | |
| 3,955,649 A | | 5/1976 | Takenoshita et al. | |
| 4,311,212 A | * | 1/1982 | Simpson | B66B 1/24 187/286 |
| 4,534,452 A | | 8/1985 | Ogasawara et al. | |
| 4,548,296 A | | 10/1985 | Hasegawa | |
| 4,637,495 A | * | 1/1987 | Blain | B66B 1/24 187/286 |

(Continued)

FOREIGN PATENT DOCUMENTS

| | | |
|---|---|---|
| JP | S5820695 A | 2/1983 |
| JP | H06255908 A | 9/1994 |

(Continued)

*Primary Examiner* — David S Warren
(74) *Attorney, Agent, or Firm* — Carlson, Gaskey & Olds

(57) ABSTRACT

An illustrative example elevator system includes an elevator car and a valve assembly that selectively directs fluid flow to control movement of the elevator car. At least one sensor provides an indication of a current status of the elevator car, which includes at least a position of the elevator car or a speed of the elevator car. A processor receives the indication from the at least one sensor and adjusts operation of the valve assembly when the current status of the elevator car is different than a predetermined desired status.

19 Claims, 2 Drawing Sheets

(56) References Cited

U.S. PATENT DOCUMENTS 4,726,450 A * 2/1988 Fossati ..... B66B 1/24 187/286
4,787,481 A 11/1988 Farar et al.
4,800,990 A * 1/1989 Blain ..... B66B 1/24 187/306
4,976,338 A 12/1990 Holland
4,991,693 A * 2/1991 Stern ..... B66B 1/24 187/286
5,014,823 A * 5/1991 Pelto-Huikko ..... B66B 1/24 187/275
5,014,824 A * 5/1991 Fargo ..... B66B 1/24 187/275
5,046,586 A * 9/1991 Pelto-Huikko ..... B66B 1/24 60/329
5,082,091 A * 1/1992 Fargo ..... B66B 1/24 187/275
5,099,957 A 3/1992 Eriksson
5,156,080 A * 10/1992 Pelto-Huikko ..... B66B 1/24 187/275
6,059,073 A * 5/2000 Gilliland ..... F16K 17/065 187/275
6,142,259 A * 11/2000 Veletovac ..... B66B 1/24 187/287
6,164,415 A * 12/2000 Takeuchi ..... B66F 9/22 187/223
6,505,711 B1 * 1/2003 Zurcher ..... B66B 1/24 187/275
6,510,923 B1 * 1/2003 Veletovac ..... B66B 1/24 187/275
6,651,781 B2 * 11/2003 Lindegger ..... B66B 1/3492 187/394
9,457,986 B2 10/2016 Bisig et al.
9,463,952 B2 * 10/2016 Romnes ..... B66B 1/3492
9,505,585 B2 11/2016 Haapaniei et al.
2014/0060977 A1 * 3/2014 Romnes ..... B66B 1/3492 187/295
2014/0158469 A1 * 6/2014 Bisig ..... B66B 1/24 187/285
2017/0022027 A1 * 1/2017 Romnes ..... B66B 1/3492
2018/0370757 A1 * 12/2018 Morrison ..... B66B 1/24
2019/0127177 A1 * 5/2019 Derbarmdiger ..... B66B 1/26

FOREIGN PATENT DOCUMENTS

JP 3003873 U 11/1994
JP H10231067 A 9/1998
JP 5310373 B2 10/2013

* cited by examiner

HYDRAULIC ELEVATOR SYSTEM WITH POSITION OR SPEED BASED VALVE CONTROL

BACKGROUND

Elevator systems have proven useful for carrying passengers or cargo between various levels of a building. The machine that is responsible for the movement and position of the elevator car is typically traction based or hydraulic. In the case of hydraulic elevators, controlling pressurized fluid (e.g., oil) achieves desired elevator car movement and position. The machine or drive controller operates a pump and valve assembly to control fluid flow and elevator car movement or position.

Most valve assemblies are set during system installation to achieve intended performance under expected or typical conditions. Temperature is one factor that affects fluid flow and that varies over the life of the elevator system. For example, the viscosity of the oil may vary at different temperatures. When the viscosity of the oil differs, the results of the preset valve assembly can vary. For example, under some temperature conditions it may not be possible to achieve a desired or target stopping position of the elevator car at a landing because the valve response is faster or slower than expected. While leveling techniques can be used to adjust the car position at the landing it is better to have the car stop at the intended position initially.

One approach to handling variations in fluid behavior in a hydraulic elevator system includes monitoring a flow rate of the fluid to compensate for changes in oil viscosity. U.S. Pat. No. 9,457,986 describes one such approach. While monitoring flow rate may be useful it does not address any other potential sources of inaccuracy in elevator car control. Additionally, the additional or new components needed for monitoring flow rate and controlling the machine based on flow rate information introduces additional cost and complexity into the elevator system.

SUMMARY

An elevator system according to an exemplary aspect of the present disclosure includes, among other things, an elevator car and a valve assembly that selectively directs fluid flow to control movement of the elevator car. At least one sensor provides an indication of a current status of the elevator car, the current status including at least a position of the elevator car or a speed of the elevator car and a processor that receives the indication from the at least one sensor and adjusts operation of the valve assembly when the current status of the elevator car is different than a predetermined desired status.

In a further non-limiting embodiment of the foregoing elevator system, the processor adjusts operation of the valve assembly to alter at least one of the current status of the elevator car and a future status of the elevator car.

In a further non-limiting embodiment of either of the foregoing elevator systems, the future status of the elevator car includes a target position of the elevator car stopped at a landing.

In a further non-limiting embodiment of any of the foregoing elevator systems, the processor determines whether the current status will result in the elevator car stopping at an actual position that differs from the target position and the processor adjusts the operation of the valve assembly to reduce a difference between the actual position and the target position.

In a further non-limiting embodiment of any of the foregoing elevator systems, the processor adjusts the operation of the valve assembly by adjusting a timing of opening or closing of the valve assembly based on a difference between the current status and the predetermined desired status.

In a further non-limiting embodiment of any of the foregoing elevator systems, the processor delays a time when the valve assembly closes to bring the elevator car to a stop when the current status includes the speed of the elevator car being below a predetermined desired speed or the processor causes the valve assembly to close sooner to bring the elevator car to a stop when the current status includes the speed of the elevator car being above a predetermined desired speed.

In a further non-limiting embodiment of any of the foregoing elevator systems, the sensor provides an absolute elevator car position.

In a further non-limiting embodiment of any of the foregoing elevator systems, the current status is a stopped position of the elevator car at a landing. The stopped position is a result of a first operation of the valve assembly. The processor determines a difference between the stopped position and a predetermined desired position of the elevator car at the landing. The processor adjusts operation of the valve assembly to a second operation during a subsequent approach of the elevator car toward the landing and the second operation reduces the difference between the predetermined desired position and the stopped position when the elevator car stops at an end of the subsequent approach.

In a further non-limiting embodiment of any of the foregoing elevator systems, the second operation includes one of a signal length or a signal timing that is different than the signal length or the signal timing of the first operation. The signal controls when or how the valve assembly closes to stop the elevator car and the signal is one of a closing signal and an opening signal.

In a further non-limiting embodiment of any of the foregoing elevator systems, the current status is a current speed of the elevator car, the processor determines a difference between the current speed and a predetermined desired speed of the elevator car and the processor adjusts operation of the valve assembly to reduce the difference while the elevator car is moving at the current speed.

A method of controlling an elevator system according to another exemplary aspect of the present disclosure includes, among other things, an elevator car and a valve assembly that selectively directs fluid flow to control movement of the elevator car. The method comprises determining a current status of the elevator car by sensing at least one of a position or a speed of the elevator car and adjusting operation of the valve assembly when the current status of the elevator car is different than a predetermined desired status.

In a further non-limiting embodiment of the foregoing method, the method includes adjusting operation of the valve assembly to alter at least one of the current status of the elevator car and a future status of the elevator car.

In a further non-limiting embodiment of either of the foregoing methods, the future status of the elevator car includes a target position of the elevator car stopped at a landing.

In a further non-limiting embodiment of any of the foregoing methods, the method includes determining whether the current status will result in the elevator car stopping at an actual position that differs from the target position and adjusting the operation of the valve assembly to reduce a difference between the actual position and the target position.

In a further non-limiting embodiment of any of the foregoing methods, the method includes adjusting the operation of the valve assembly by adjusting a timing of opening or closing of the valve assembly based on a difference between the current status and the predetermined desired status.

In a further non-limiting embodiment of any of the foregoing methods, adjusting operation of the valve assembly comprises closing the valve assembly later to bring the elevator car to a stop when the current status includes the speed of the elevator car being below a predetermined desired speed or closing the valve assembly sooner to bring the elevator car to a stop when the current status includes the speed of the elevator car being above a predetermined desired speed.

In a further non-limiting embodiment of any of the foregoing methods, the elevator system includes a sensor that provides an indication of absolute elevator car position and the current status includes at least the absolute elevator car position.

In a further non-limiting embodiment of any of the foregoing methods, the current status is a stopped position of the elevator car at a landing, the stopped position is a result of a first operation of the valve assembly. The method comprises determining a difference between the stopped position and a predetermined desired position of the elevator car at the landing and adjusting operation of the valve assembly to a second operation during a subsequent approach of the elevator car toward the landing. The second operation reduces the difference between the predetermined desired position and the stopped position at an end of the subsequent approach.

In a further non-limiting embodiment of any of the foregoing methods, the second operation includes one of a closing signal timing that is different than the closing signal timing of the first operation and the closing signal controls when or how the valve assembly closes to stop the elevator car.

In a further non-limiting embodiment of any of the foregoing methods, the current status is a current speed of the elevator car and the method comprises determining a difference between the current speed and a predetermined desired speed of the elevator car and adjusting operation of the valve assembly to reduce the difference while the elevator car is moving at the current speed.

The various features and advantages of at least one disclosed example embodiment will become apparent to those skilled in the art from the following detailed description. The drawings that accompany the detailed description can be briefly described as follows.

DETAILED DESCRIPTION

Example embodiments of this invention provide the ability to adjust the operation of a valve assembly in a hydraulic elevator system. Using absolute position or velocity information allows for adjusting valve control to address various issues that may arise over the useful life of the elevator system. Embodiments of this invention may be readily incorporated into existing hydraulic elevator systems without requiring any modification to the valve assembly or the machine controller.

Figure 1:
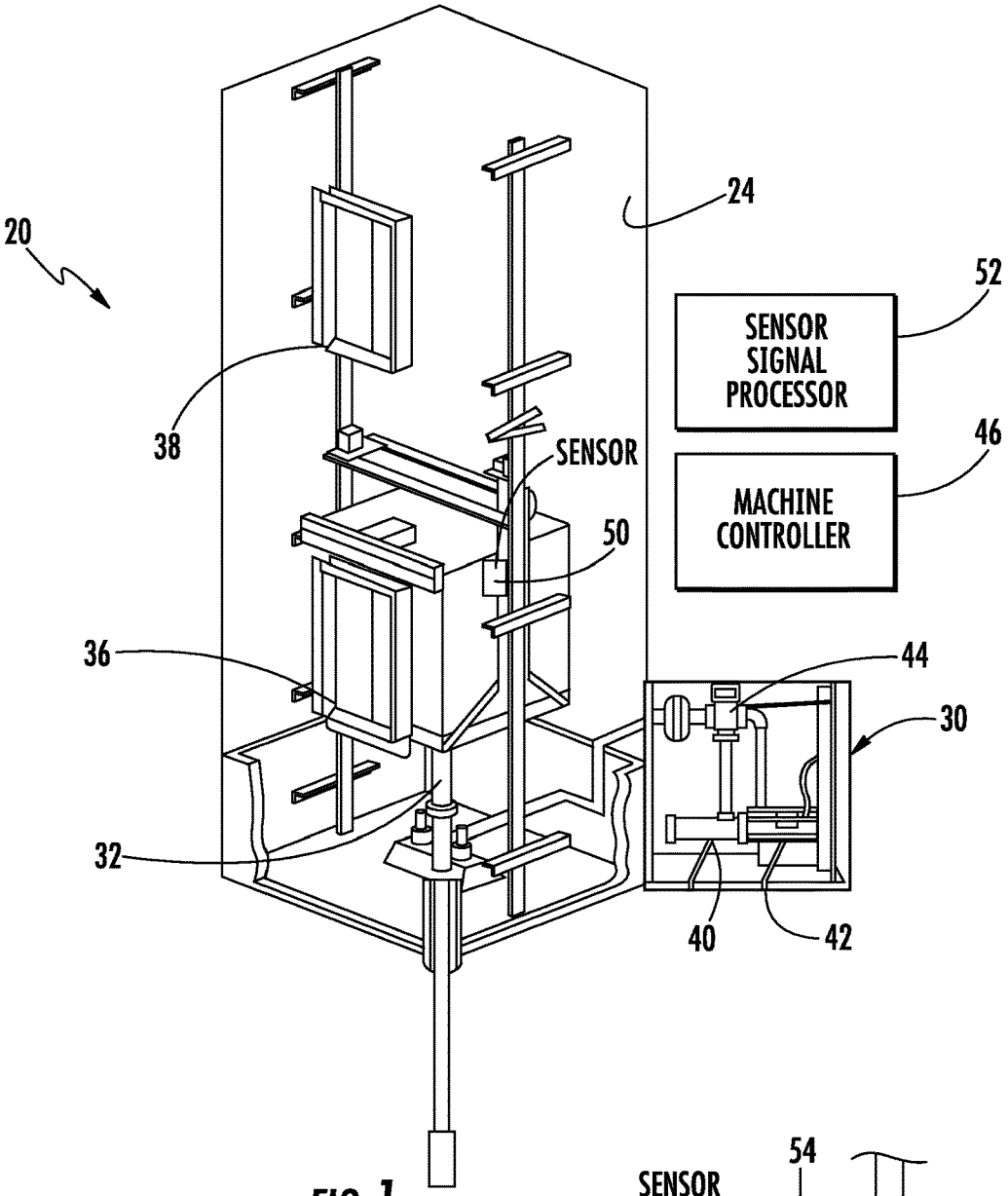
FIG. 1 schematically illustrates selected portions of an elevator system designed according to an embodiment of this invention.

FIG. 1 schematically illustrates selected portions of a hydraulic elevator system 20. An elevator car 22 is situated for movement in a hoistway 24 in a known manner. A machine 30 causes extension or contraction of a plunger assembly 32 to move the elevator car 22 through the hoistway 24. The machine 30 also holds the elevator car at a landing 36 or 38 as needed. Only two landings are shown for discussion purposes but those skilled in the art will realize that other numbers of landings are possible and that other plunger arrangements could be used.

The machine 30 includes a pump 40, a motor 42 and a valve assembly 44. A machine controller 46 controls whether the pump 40 operates and the position or condition of the valve assembly 44 to achieve the desired movement or position of the elevator car. In some embodiments the valve assembly 44 is a known four-way valve and the machine controller 46 operates according to known principles.

Figure 2:
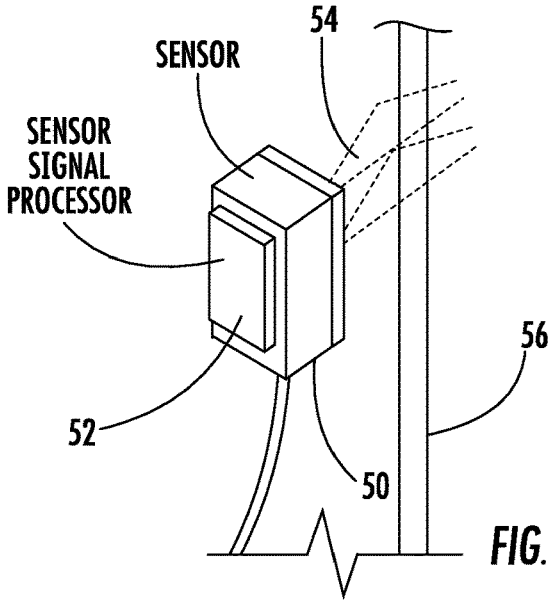
FIG. 2 diagrammatically illustrates selected features of an example sensor and processor designed according to an embodiment of this invention.

The example elevator system 20 includes at least one sensor 50 that provides an indication of a status of the elevator car 22 and a sensor signal processor 52. The sensor 50 in this example is capable of providing absolute position information regarding the position of the elevator car 22. The sensor 50 is also capable of providing absolute velocity information. As shown in FIG. 2, the example sensor 50 has at least one camera or reader field of vision 54 so the sensor reads a tape or other marker 56 situated in the hoistway. Other sensor configurations that provide absolute position or absolute velocity information are used in some embodiments.

A sensor signal processor 52 interprets indications from the sensor 50 regarding the position of the elevator car 22. The example processor 52 also uses position information over time to determine a speed of elevator car movement under at least some circumstances. At least one of the position and speed of the elevator car 22 is used as status information in the example embodiment.

One aspect of the illustrated embodiment is that the processor 52 may be situated anywhere in the elevator system 20. The schematic representation in FIG. 1 separates the processor 52 from the machine controller 46 for discussion purposes. In some embodiments the processor 52 is part of or incorporated into the machine controller 46 while in others the processor 52 is a separate device from the machine controller 46. In embodiments that include separate components, the processor 52 is capable of communicating with the machine controller 46 using wire-based or wireless communication.

One example sensor and processor embodiment is shown in FIG. 2. The processor 52 is supported by a housing of the sensor 50. In such an embodiment in which the sensor 50 and processor 52 are supported on the elevator car, the processor 52 interprets and processes the indications from the sensor 50 and communicates them to the machine controller 46 over the travelling cable (not illustrated).

When the processor 52 is a separate device or component from the machine controller 46, the sensor 50 and processor 52 may be readily incorporated into an existing elevator system for an economical retrofit option. The processor 52 in such embodiments is configured to interpret the absolute position (and velocity) indications from the sensor 50 and to convert them into signals that are recognizable by the machine controller 46 for controlling the valve assembly 44. For example, in an elevator system that already has a machine controller 46 that uses discrete input signals for valve operation control, the processor 52 converts the signals or indications from the sensor 50 into discrete signals according to the signaling format or protocol that the machine controller 46 uses. That way the capabilities of an embodiment of this invention can be readily incorporated into an existing elevator system.

The processor 52 determines if the status of the elevator car deviates from a predetermined desired status and controls how the signals are communicated to the machine controller 46 to adjust the operation of the valve 44 to bring the elevator status closer to the desired status. By controlling the signal(s) that the machine controller 46 uses for controlling the valve assembly 44, the processor adjusts the valve assembly operation.

Figure 3:
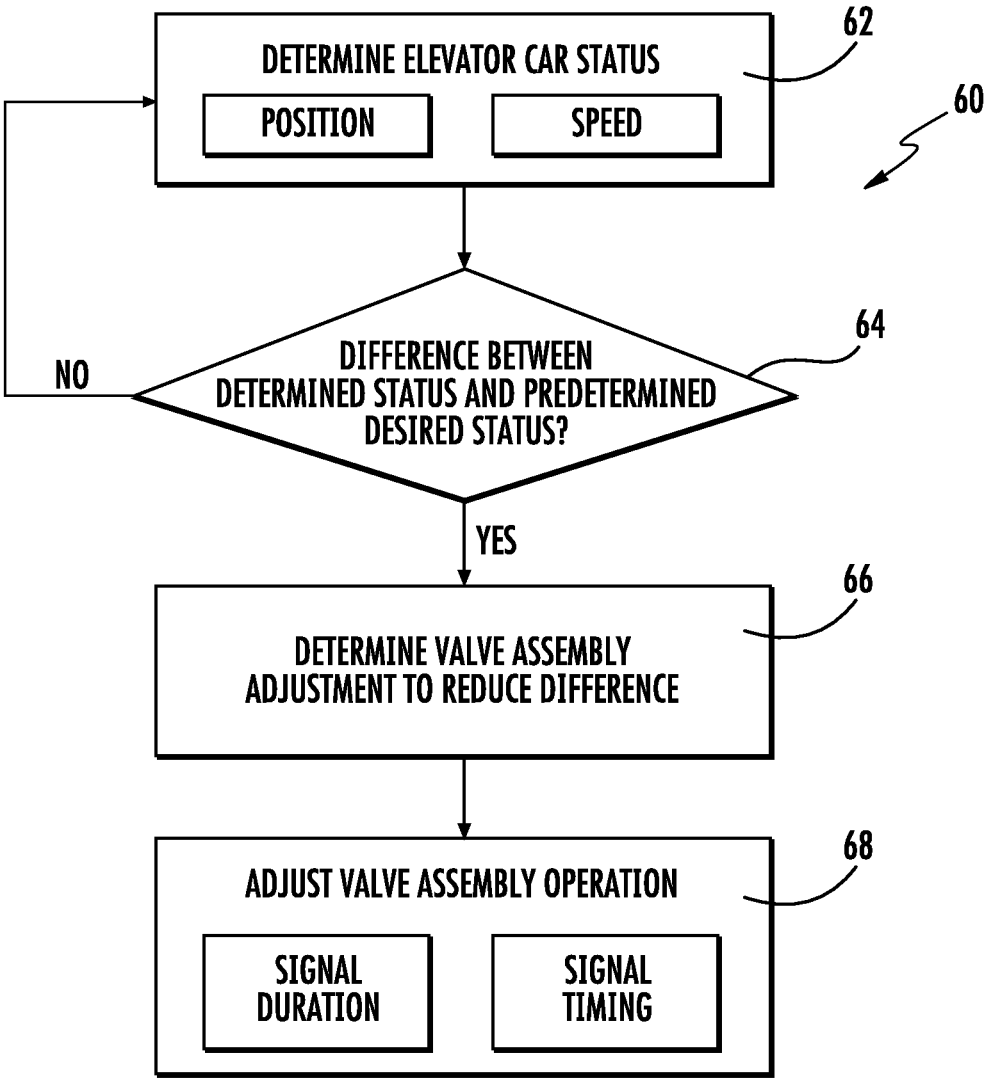
FIG. 3 is a flow chart diagram summarizing an example valve adjustment and elevator car control technique designed according to an embodiment of this invention.

FIG. 3 summarizes an example approach in a flow chart 60. At 62, the processor 52 determines the elevator status by interpreting the indication(s) from the sensor 50 regarding the position of the elevator car 22. In situations where speed information is useful, the determined status includes the speed of elevator car movement. At 64, the processor determines if the current status is different than a predetermined desired status. For example, if the desired status is a position of the elevator car 22 at the landing 36, the processor 52 compares the position information from the sensor 50 to a previously stored desired position. If there is no difference then the elevator system continues to operate as it has been. If, on the other hand, there is a difference at 64, the processor determines a valve assembly adjustment to reduce or eliminate the difference between the determined status and the desired status. Then at 68 the processor 52 controls how signals are provided to the machine controller 46 to adjust operation of the valve assembly 44 in a manner that will reduce the difference between the actual status and the desired status. In this example, the processor 52 controls communication of the signal(s) to the machine controller 46, such as the signal duration or the timing of the signal, to achieve the desired valve assembly operation adjustment.

The valve assembly adjustment occurs in some situations to correct the elevator status during a subsequent elevator run that includes the same or a similar desired status. For example, assume the elevator car 22 did not stop at the desired position at the landing 36 but, instead, overshot or passed by the desired position. The processor 52 determines that and changes the timing of the signal used by the machine controller 46 for closing the valve assembly to bring the elevator car 22 to a stop. If the overshoot was due to higher viscosity associated with cold oil in the system, having the valve assembly begin to close sooner will allow it to close in time to bring the elevator car to a stop 22 in the desired position.

In some situations, the adjustment(s) provided by the processor 52 controlling the timing of signals to the machine controller occur during an elevator status event or even in anticipation of a status. For example, if the current elevator speed is higher than a contract speed, stopping the elevator car 22 will require adjusted valve assembly operation compared to that used when the elevator car 22 is travelling at the contract speed. The processor 52 in the illustrated example is programmed or otherwise configured to make that determination before the elevator car 22 reaches the stop and adjusts the signal(s) provided to the machine controller to reduce what otherwise would have been a difference in the target stopping position and the actual stopping position.

With absolute position and corresponding velocity or speed information available to the processor 52, adjustments can be made continuously during elevator system operation to keep the status of the elevator car 22 as close as possible to a predetermined desired status.

Whether the corrections provided by the processor 52 controlling the signaling to the machine controller 46 for adjusting valve assembly operation occur to correct any errors from a previous run during a subsequent run or during a current run, the processor 52 enhances elevator system operation in a manner that addresses a variety of sources of potential errors in elevator car status. For example, the load on the elevator car, the condition of the pump 40, the condition of the valve assembly 44, the viscosity of the oil, or any combination of these may affect how the machine 40 is able to control elevator car position or movement. The illustrated example embodiment can be used to adapt valve assembly operation to address any such issues.

Additionally, the speed information from the sensor 50 is used in some embodiments to generate a fault indication when conditions indicate a fault, which may be useful to shut down the elevator or to generate a notice that maintenance is required. Further, the resulting system operation based on the adjustments to the valve assembly operation are useful as a measure of system health and may be used for indications of a need for maintenance if appropriate.

One feature of the illustrated example sensor 50 and processor 52 arrangement is that it can be incorporated into a variety of existing elevator configurations without having to alter the elevator system components. The machine controller 46 of an existing system need not be replaced or reconfigured. Also, the valve assembly 44 does not need to be modified or replaced. The disclosed example embodiment provides economic benefits and superior elevator system performance. As mentioned above, in some embodiments the functionality of the processor 52 is incorporated into the machine controller 46, which may be done prior to installation or through a software or firmware update depending on the configuration of the machine controller 46.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car;

a valve assembly that selectively directs fluid flow to control movement of the elevator car;

at least one sensor that provides an indication of a current status of the elevator car, the current status including at least a position of the elevator car or a speed of the elevator car; and a processor that receives the indication from the at least one sensor and adjusts operation of the valve assembly when the current status of the elevator car is different than a predetermined desired status;

wherein the processor adjusts the operation of the valve assembly by adjusting a timing of opening or closing of the valve assembly based on a difference between the current status and the predetermined desired status;

the processor delays a time when the valve assembly closes to bring the elevator car to a stop when the current status includes the speed of the elevator car being below a predetermined desired speed; or the processor causes the valve assembly to close sooner to bring the elevator car to a stop when the current status includes the speed of the elevator car being above a predetermined desired speed.

2. The elevator system of claim 1, wherein the processor adjusts operation of the valve assembly to alter at least one of the current status of the elevator car and a future status of the elevator car.

3. The elevator system of claim 2, wherein the future status of the elevator car includes a target position of the elevator car stopped at a landing.

4. The elevator system of claim 3, wherein the processor determines whether the current status will result in the elevator car stopping at an actual position that differs from the target position; and the processor adjusts the operation of the valve assembly to reduce a difference between the actual position and the target position.

5. The elevator system of claim 1, wherein the sensor provides an absolute elevator car position.

6. The elevator system of claim 1, wherein the current status is a stopped position of the elevator car at a landing;

the stopped position is a result of a first operation of the valve assembly;

the processor determines a difference between the stopped position and a predetermined desired position of the elevator car at the landing;

the processor adjusts operation of the valve assembly to a second operation during a subsequent approach of the elevator car toward the landing; and the second operation reduces the difference between the predetermined desired position and the stopped position when the elevator car stops at an end of the subsequent approach.

7. The elevator system of claim 6, wherein the second operation includes one of a signal length or a signal timing that is different than the signal length or the signal timing of the first operation, the signal controls when or how the valve assembly closes to stop the elevator car, and the signal is one of a closing signal and an opening signal.

8. The elevator system of claim 1, wherein the current status is a current speed of the elevator car;

the processor determines a difference between the current speed and a predetermined desired speed of the elevator car; and the processor adjusts operation of the valve assembly to reduce the difference while the elevator car is moving at the current speed.

9. A method of controlling an elevator system including an elevator car and a valve assembly that selectively directs fluid flow to control movement of the elevator car, the method comprising:

determining a current status of the elevator car by sensing at least one of a position or a speed of the elevator car; and adjusting operation of the valve assembly when the current status of the elevator car is different than a predetermined desired status, wherein adjusting operation of the valve assembly comprises closing the valve assembly later to bring the elevator car to a stop when the current status includes the speed of the elevator car being below a predetermined desired speed; or closing the valve assembly sooner to bring the elevator car to a stop when the current status includes the speed of the elevator car being above a predetermined desired speed.

10. The method of claim 9, comprising adjusting operation of the valve assembly to alter at least one of the current status of the elevator car and a future status of the elevator car.

11. The method of claim 10, wherein the future status of the elevator car includes a target position of the elevator car stopped at a landing.

12. The method of claim 11, comprising determining whether the current status will result in the elevator car stopping at an actual position that differs from the target position; and adjusting the operation of the valve assembly to reduce a difference between the actual position and the target position.

13. The method of claim 9, comprising adjusting the operation of the valve assembly by adjusting a timing of opening or closing of the valve assembly based on a difference between the current status and the predetermined desired status.

14. The method of claim 9, wherein the elevator system includes a sensor that provides an indication of absolute elevator car position; and the current status includes at least the absolute elevator car position.

15. The method of claim 9, wherein the current status is a stopped position of the elevator car at a landing;

the stopped position is a result of a first operation of the valve assembly; and the method comprises determining a difference between the stopped position and a predetermined desired position of the elevator car at the landing; and adjusting operation of the valve assembly to a second operation during a subsequent approach of the elevator car toward the landing, wherein the second operation reduces the difference between the predetermined desired position and the stopped position at an end of the subsequent approach.

16. The method of claim 15, wherein the second operation includes one of a closing signal timing that is different than the closing signal timing of the first operation, and the closing signal controls when or how the valve assembly closes to stop the elevator car.

17. The method of claim 9, wherein the current status is a current speed of the elevator car and the method comprises determining a difference between the current speed and a predetermined desired speed of the elevator car; and adjusting operation of the valve assembly to reduce the difference while the elevator car is moving at the current speed.

18. An elevator system, comprising:

an elevator car;

a valve assembly that selectively directs fluid flow to control movement of the elevator car;

at least one sensor that provides an indication of a current status of the elevator car, the current status including at least a position of the elevator car or a speed of the elevator car; and a processor that receives the indication from the at least one sensor and adjusts operation of the valve assembly when the current status of the elevator car is different than a predetermined desired status;

wherein the current status is a stopped position of the elevator car at a landing;

the stopped position is a result of a first operation of the valve assembly;

the processor determines a difference between the stopped position and a predetermined desired position of the elevator car at the landing;

the processor adjusts operation of the valve assembly to a second operation during a subsequent approach of the elevator car toward the landing;

the second operation reduces the difference between the predetermined desired position and the stopped position when the elevator car stops at an end of the subsequent approach;

the second operation includes one of a signal length or a signal timing that is different than the signal length or the signal timing of the first operation, the signal controls when or how the valve assembly closes to stop the elevator car, and the signal is one of a closing signal and an opening signal.

19. A method of controlling an elevator system including an elevator car and a valve assembly that selectively directs fluid flow to control movement of the elevator car, the method comprising:

determining a current status of the elevator car by sensing at least one of a position or a speed of the elevator car; and adjusting operation of the valve assembly when the current status of the elevator car is different than a predetermined desired status, wherein the current status is a stopped position of the elevator car at a landing;

the stopped position is a result of a first operation of the valve assembly; and the method comprises determining a difference between the stopped position and a predetermined desired position of the elevator car at the landing;

adjusting operation of the valve assembly to a second operation during a subsequent approach of the elevator car toward the landing, wherein the second operation reduces the difference between the predetermined desired position and the stopped position at an end of the subsequent approach;

the second operation includes one of a closing signal timing that is different than the closing signal timing of the first operation, and the closing signal controls when or how the valve assembly closes to stop the elevator car.

* * * * *